US005207391A

United States Patent [19]

Anderson

[11] Patent Number: 5,207,391

[45] Date of Patent: May 4, 1993

[54] TUB GRINDER

[76] Inventor: Robert R. Anderson, 29774 Hwy. 257, Windsor, Colo. 80550

[21] Appl. No.: 917,771

[22] Filed: Jul. 21, 1992

Related U.S. Application Data

[63] Continuation-in-part of Ser. No. 727,069, Jul. 9, 1991, abandoned.

[51] Int. Cl.[5] ..... B02C 13/06

[52] U.S. Cl. ..... 241/186.4; 241/186.5; 241/189.1

[58] Field of Search ..... 241/186.4, 186.5, 189.1, 241/74

[56] References Cited

U.S. PATENT DOCUMENTS

| | | | |
|---|---|---|---|
| 3,436,028 | 4/1969 | Koehnen et al. | 241/186.5 |
| 3,652,020 | 3/1972 | Kopps et al. | 241/186.5 |
| 4,003,502 | 1/1977 | Barcell | 222/168 |
| 4,087,051 | 5/1978 | Moeller | 241/27 |
| 4,106,706 | 8/1978 | Burrows | 241/186.2 |
| 4,998,676 | 3/1991 | Sirol | 241/55 |

FOREIGN PATENT DOCUMENTS

| | | | |
|---|---|---|---|
| 0121751 | 10/1984 | European Pat. Off. | 241/186.4 |
| 627320 | 3/1936 | Fed. Rep. of Germany | 241/189 R |
| 2361939 | 4/1978 | France | 241/74 |
| 0650554 | 3/1979 | U.S.S.R. | 241/186.4 |
| 1431831 | 10/1988 | U.S.S.R. | 241/186.5 |

*Primary Examiner*—Mark Rosenbaum
*Assistant Examiner*—John M. Husar
*Attorney, Agent, or Firm*—Dean P. Edmundson

[57] ABSTRACT

Improved tub grinding apparatus is described for grinding bulk materials. A concave restricter is positioned adjacent to and extends along the length of a rotatable rotor. The spacing between the concave restricter and the rotor is adjustable for determining the particle size of the resulting ground material. An auger is positioned adjacent to and along the length of the rotor for receiving ground bulk material and conveying it away from the rotor. The auger is laterally spaced from the axis of the rotor. The apparatus has a lower profile than conventional tub grinders.

17 Claims, 2 Drawing Sheets

TUB GRINDER

CROSS-REFERENCE TO RELATED APPLICATION

This application is a continuation-in-part of application Ser. No. 07/727,069, filed Jul. 9, 1991 now abandoned.

FIELD OF THE INVENTION

This invention relates to material processors or grinders of the type which are used to grind bulk materials or reduce the particle size of bulk materials. More particularly, this invention relates to tub grinders which are used to grind bulk materials and reduce the particle size of the material.

BACKGROUND OF THE INVENTION

Material processors for reducing the particle size of bulk materials have been used for centuries in one form or another. One type of material processor of more recent use is known as a tub grinder. This type of apparatus includes a large tub having an open top for receiving bulk material to be processed. A stationary floor in the tub is in a generally horizontal plane.

A rotor member is mounted under the floor, and hammers or blades on the rotor extend into the tub through an opening in the stationary floor. The rotor is rotated at a high rate of speed, and the tub is rotated slowly. The hammers or blades on the rotor strike the bulk material and grind it into smaller particles. A screen having small apertures in it is positioned in close proximity to the rotor under the floor. The bulk material cannot pass through the screen until the particles are smaller than the apertures.

As the tub is rotated the bulk material is continually urged against the revolving rotor member. The processed bulk material either falls through the screen system and is carried out by conveying or it is carried around the rotor by the hammers and thrown out the back side of the rotor and back into the tub where it is pushed around again by the rotating tub. Then the process is repeated.

Because all of the bulk material particles are forced through a screen in a conventional tub grinder, the speed of processing the bulk material is limited and significant horsepower is required to operate the grinder. Bulk material stored outside tends to become wet and tough due to inclement weather. When putting such types of bulk material in the conventional tub grinder, the screen plugs up easily, thereby making grinding very difficult or impossible. Also, different screens must be used to obtain different particle size processed material. Another disadvantage of conventional tub grinders is that they tend to blow material out of the top of the tub when there is only a small amount of material in the tub.

Conventional tub grinders place the discharge conveying systems below the rotor member. Consequently, the tub and rotor must be positioned above the conveying system. This makes it more difficult to dump bulk material into the open top of the tub, because of the height from the ground to the top of the tub.

A conventional tub grinder is described, for example, in U.S. Pat. No. 4,106,706 (Burrows). This type of grinder is referred to as a "cut-and-throw" machine where the rotating hammers move the bulk material down through the opening in the floor, past shear plates where the material is ground, and then the material is propelled at high speed out through an exit spout. The rapidly rotating hammermill generates an air stream which is intended to push the particles upwardly through the discharge chute.

The discharge chute or spout can easily become plugged when the bulk material is wet or is of the type which becomes easily compacted after being ground. Then the grinding operation must be stopped in order to manually clean out the discharge chute. This can be a very cumbersome and time-consuming task.

Also, the conventional tub grinder tends to cause undesirable separation of the ground material as it is blown or thrown out of the discharge chute. Not only does this result in the formation of a considerable amount of dust, it can also result in a very non-uniform distribution of the particles in the feed produced. Further, the conventional tub grinder of the type described above does not have the capability to allow a screen to be included adjacent the rotating hammers for the purpose of causing the particles to be reduced to even smaller size before they exit the machine.

European Patent Application No. 0121751 describes a tub machine having a rotor in the floor. The rotor includes knives which cut through bulk material such as hay or straw. The machine does not appear to be capable of handling material such as wood pallets or other material which is difficult to grind. The cut material falls downwardly to an auger for conveying the material to a blower for lifting and blowing the material out through a discharge chute. Thus, the apparatus can exhibit the same problems as exhibited by the Burrows machine described above.

Another conventional tub grinder is described in U.S. Pat. No. 4,003,502 (Barcell). This grinder has positionable blades on the sidewalls. The blades are rigid and are securely held in one position. Bolts extend through the blades and through the rib of the side wall to prevent movement of the blades while operating the grinder. The position of the blades is adjustable only by removing bolts when the grinder is at rest.

U.S. Pat. No. 4,087,051 (Moeller) also describes a tub grinder of the cut-and-throw type. S.U. 650,554 also describes a conventional tub grinder which has been modified to include an auger above the floor to carry the bulk material toward the center of the hopper to load the hammers evenly. Germany Patent 627,320 appears to describe a hammermill where the hammers are tilted away from vertical.

Another disadvantage of conventional tub grinders is that they tend to throw material upwardly out of the tub when the tub is nearly empty. This can be potentially dangerous when the material thrown out of the tub is a chunk of metal, rock, or other hard object.

There has not heretofore been provided tub grinding apparatus having the advantages provided by the present invention.

SUMMARY OF THE PRESENT INVENTION

In accordance with the present invention there is provided improved tub grinding apparatus for grinding bulk materials which exhibits significant advantages over conventional tub grinders.

In a preferred embodiment the improved apparatus includes concave restricter means positioned adjacent to and extending substantially along the length of the rotor member. The position of the restricter means relative to the rotor member is adjustable so as to govern the resulting particle size of the processed material. Auger means is positioned adjacent to the rotor member for receiving the processed material from the rotor and for conveying the material away from the rotor and to an elevator or other conveyor, e.g., so that the processed material can be put into a pile or into a truck, trailer, etc. The auger means is laterally spaced from the axis of the rotor member.

The tub grinding apparatus of the invention requires less horsepower to operate than prior devices and is therefore more efficient. It is also easy to control the particle size of the processed material without the use of many different sizes of screens.

The apparatus of this invention avoids the problem of wet material clogging the discharge operation. It also avoids the undesirable separation of the ground material. The use of the auger to convey the particles of bulk material results in a very uniform mixture of all of the different sizes of particles. This is very desirable and avoids the formation of dust clouds. Another advantage is that a screen may be placed between the hammermill and the auger for the purpose of preventing particles from exiting until they are of the desired size.

Yet another advantage of the apparatus of this invention is that it has a low profile. This makes it easier to load bulk material into the tub for grinding. It also enables the machines to be vertically stacked for transporting from the factory.

Other advantages of the apparatus of this invention will be apparent from the following detailed description.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
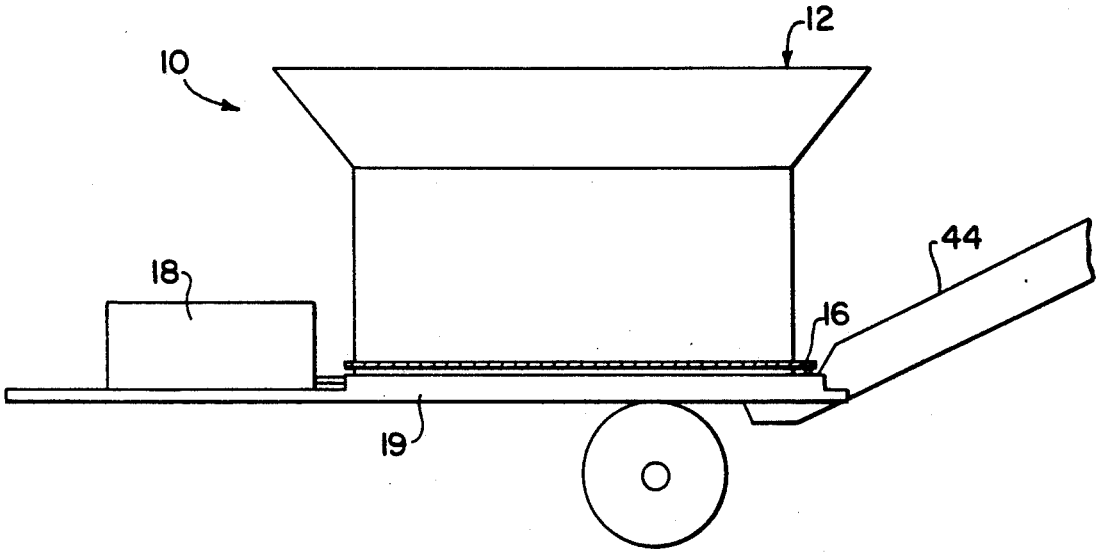
FIG. 1 is a side elevational view of one embodiment of tub grinding apparatus of this invention.
Figure 2:
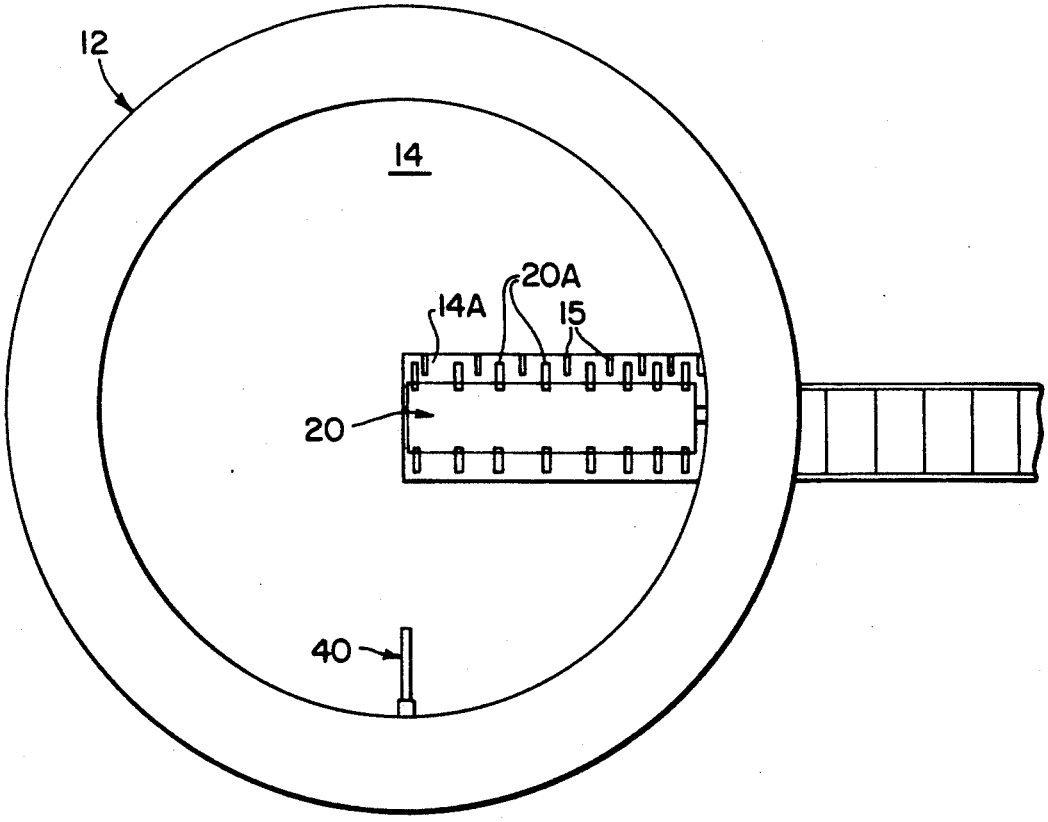
FIG. 2 is a top view showing the tub and elevator portions of the apparatus of FIG. 1.

In the drawings there is shown tub grinding apparatus 10 for grinding bulk materials. The apparatus includes a rotatable tub member 12 having upright side walls and an open top. The upper portion of the side walls may be flared outwardly, as illustrated. The lower portion of the tub is generally cylindrical. There is a stationary floor 14 which includes an opening 14A.

An elongated rotor member 20 is horizontally disposed and carried below the floor in a manner such that radially-extending hammer elements or blades 20A at the top or upper portion of the rotor extend through the opening 14A in the stationary floor. Preferably the opening 14A extends from the side wall of the tub to the center of the floor. The rotor member is rotatable about a horizontal axis.

The tub 12 is adapted to be rotated about its central axis, while the floor 14 remains stationary. In this manner, bulk material which is placed into the tub through the open top falls to the floor area and is impacted by the hammer elements of the rotor member as the rotor member is rotated at high speed. The tub is generally caused to rotate by means of an endless chain 16 which extends around the periphery of the tub near its lower end and which also extends around a drive sprocket.

Figure 4:
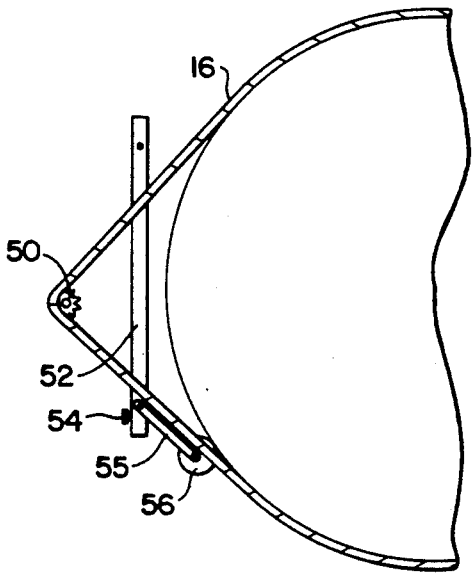
FIG. 4 is a top view illustrating a preferred drive system for rotating the tub.

A preferred drive arrangement for the tub is shown in FIG. 4. The chain 16 extends around the exterior of the tub and also engages drive gear 50. Guide roller 56 is rotatably carried on the outer end of arm 55. The opposite end of arm 55 is pivotably attached to bar 52 secured to the frame of the apparatus. Bolt 54 is threadably carried by bar 52 and it engages arm 55. By tightening bolt 54 this pushes arm 55 (and thus roller 56) toward the tub. This causes the drive chain 16 to be tightened. By loosening bolt 54, the drive chain 16 is loosened.

Power is supplied to the rotating tub apparatus either by means of an engine 18 carried on the frame 19 of the apparatus or by means of a power take-off shaft operably connected to an engine, tractor, etc. Appropriate gear boxes and drive train connect the power source to the rotating tub and to the rotor member, as required.

Figure 3:
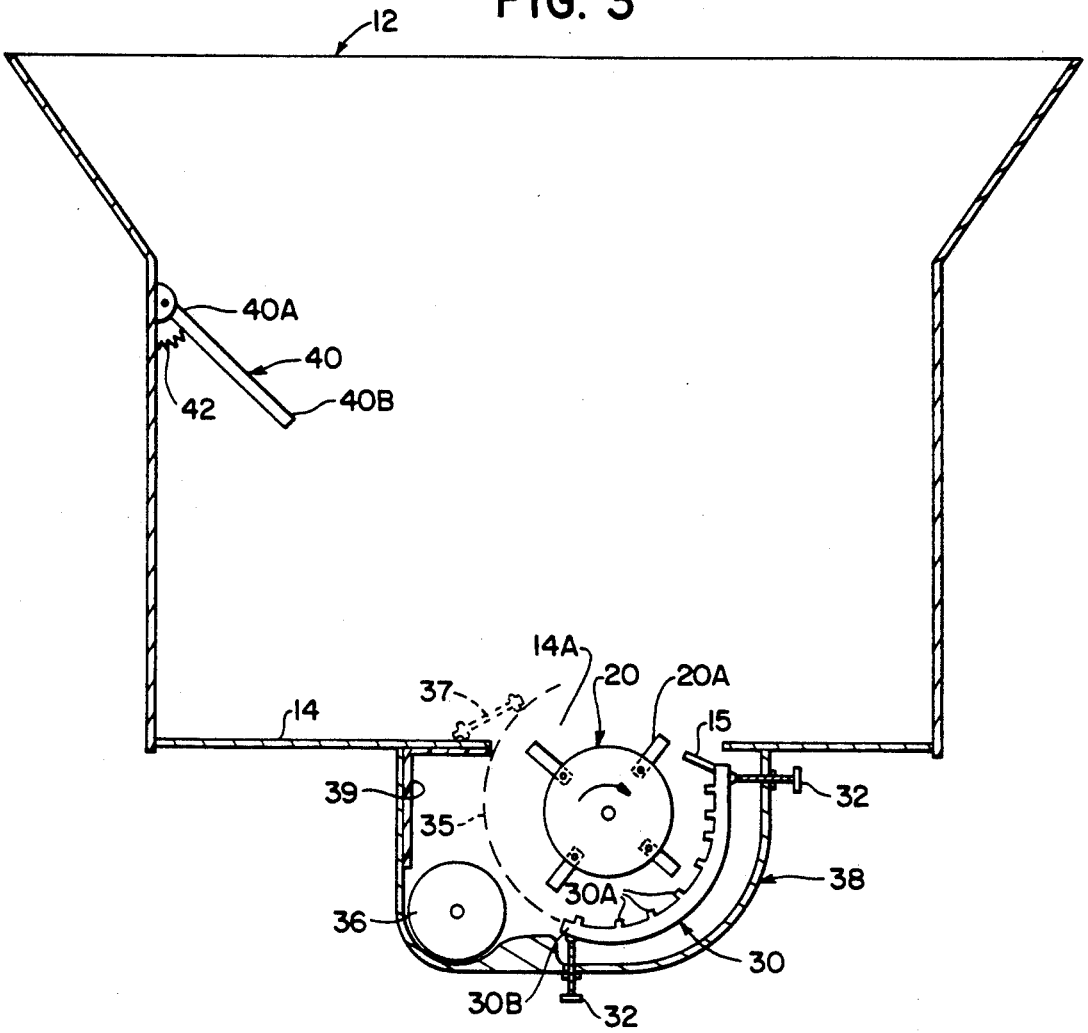
FIG. 3 is a cross-sectional view of the tub portion of the embodiment of FIG. 1.

As illustrated in FIG. 3, when the rotor member is driven in the direction of the arrow the hammer elements 20A extend through the opening 14A in floor 14 and impact upon the lowermost portion of the bulk material present in the tub 12. The action of the hammer elements is to tear the bulk material apart and reduce its particle size. The bulk material which is forced by the hammer elements to move downwardly through the opening 14A must pass between the rotor member and a concave restricter means 30 which causes the bulk material to become repeatedly impacted by the hammer elements and thereby further reduced in particle size. The processed bulk material is then urged by the rotor member into an elongated auger member 36 which is aligned adjacent to and parallel with the rotor member, as illustrated, for conveying the processed material out of the apparatus to a conveyor means such as a conveyor belt or elevator 44 at the rear of the apparatus. The processed bulk material can then be loaded into a truck, trailer, etc., or it may be simply piled on the ground or platform for later use.

Preferably the concave restricter means 30 is a stationary element which extends along and adjacent to the full length of the rotor member. The restricter means 30 extends from its upper end which is positioned in close proximity to the opening 14A in floor 14 downwardly to its lower end which is positioned beneath the rotor member. It is also preferable for the restricter means 30 to include a plurality of spaced-apart ribs 30A which impede the bulk material as it passes between the rotor member and the restricter and assists in causing the bulk material to become reduced in particle size. The ribs 30A may also include raised projections or protrusions which extend toward the rotor member. As another alternative, the raised ribs may vary in height along their length, if desired.

The concave restricter means 30 is adjustable relative to its spacing and orientation with respect to the rotor member. In other words, the restricter means 30 may be moved closer to or farther away from the rotor member in order to decrease or increase, respectively, the size of the opening present between the extended hammer elements of the rotor and the working surface of the restricter means 30. For this purpose, there are, for example, threaded bolts 32 at the upper and lower portions of the restricter means 30 for enabling adjustment of the relative positions of the upper and lower portions of the restricter means 30 with respect to the rotor member. It is also possible for the restricter means 30 to be pivoted relative to its lower edge 30B in a manner such that the spacing between the rotor member and the restricter means 30 near the opening 14A may be selectively adjusted such that it may be larger or smaller than the spacing between the rotor member and the restricter means 30 near the lower edge 30B of the restricter means 30.

The adjustability of the position of the restricter means 30 relative to the rotor member is extremely important. This adjustability enables one to carefully control the resulting particle size of the bulk material being processed by the apparatus. By making the spacing between the rotor member and the restricter means 30 very small, the resulting particle size of the bulk material will be accordingly smaller than when the spacing between the rotor member and the restricter means 30 is widened.

The provision of auger means adjacent and parallel to the rotor member is extremely important and advantageous because this enables the processed bulk material to be smoothly and rapidly drawn away from the rotor member in an efficient manner. This accordingly enables the apparatus of this invention to process bulk material more rapidly and efficiently than has been available previously. Also, the use of the concave restricter means shown and described herein also facilitates smooth and efficient operation of the apparatus.

The auger is laterally spaced from the axis of the rotor, as illustrated in FIG. 3. The height of the auger relative to the restricter is also important. The lower edge of the auger does not extend below the bottom of the restricter by more than about six inches (preferably not more than about two inches). Even more preferably the lower edge of the auger does not extend below the bottom of the restricter. The lower edge of the auger may be located at a position higher than the bottom of the restricter, if desired.

Preferably housing 38 beneath the floor of the tub encloses the auger 36, restricter 30, and rotor 20, as shown in FIG. 3. Preferably one interior wall portion of the housing is covered with a wear plate 39 to protect the housing wall from impacts by high velocity chunks of metal, rock or other hard materials driven by the rotor 20 during operation of the apparatus. For example, when wooden pallets or other such material is being ground in the apparatus, nails or other pieces of metal are driven to high speeds by the operation of the rotor. Some of such materials may impact against the housing wall which is adjacent the side of the rotor opposite the side where the restricter 30 is located. The wear plate may also extend under the floor of the tub where high speed driven items may impact.

The wear plate(s) may be detachable from the housing, if desired, so as to enable them to be replaced. For example, the wear plates may be bolted to the interior wall of the housing. The wear plate(s) may comprise steel or other shock-resistant and wear-resistant material (e.g., high-impact plastic or composite material). The thickness of the wear plate may vary, as desired. Preferably the wear plate extends along the housing a distance equal to the length of the rotor.

It is also preferable to include spaced-apart finger members 15 which extend from the top edge of the restricter means 30 upwardly at an inclined angle toward the rotor member 20. The purpose of fingers 15 is to restrict slugs or wads of bulk material from being drawn in by the hammer elements 20A. Accordingly, fingers 15 assist in providing an even flow of bulk material into the space between the rotor and the restrictor means 30. The length of the fingers 15, and the spacing between fingers, may vary as desired. It is important not to make them so long that they contact the rotor member when the concave restrictor 30 is moved to its closest position next to the rotor member.

If desired, it is also possible to include a screen member 35 between the rotor member and the auger means. The screen member (shown in dotted lines in FIG. 3) may be held in position by one or bolts 37 and would be used only if an especially fine grind or very small particle size is desired for the processed bulk material. The screen member would follow the contour of the rotor and hammers, as illustrated. As shown in FIG. 3, preferably the upper edge of the screen member extends above the floor and curves partially over the upper side of the rotor. The purpose for this is to deflect material driven upwardly by the rotor so that such material is not driven upwardly and out over the top of the tub grinder. In conventional grinders, it is possible for heavy material to be propelled upwardly and over the top of the tub. The screen illustrated herein prevents this from happening.

Another feature of the apparatus shown in the drawings is the provision of one or more paddle means which is secured to an upright wall of the tub member. As shown in the drawings, a paddle 40 may be pivotably attached at one end 40A to the interior wall of the tub. The other end 40B of the paddle extends inwardly and downwardly into the tub. Bias means such as a spring 42 urges the paddle member into the tub in the manner shown. When bulk material is placed into the tub it can cause the paddle member to be urged against spring 42 toward the interior wall of the tub. The presence of the paddle on the interior wall is for the purpose of engaging the bulk material and urging it to rotate along with the tub so that the bulk material is continually urged against the rotor member 20. Because the paddle 40 may be urged against or toward the interior wall of the tub, the paddle will not cause the bulk material to bridge in the tub over the rotor. Previous tub grinders have utilized a stationary fixed paddle which sometimes does enable the bulk material to become wedged in the tub or to bridge over the rotor member.

Other variants are possible without departing from the scope of the present invention.

What is claimed is:

1. Tub grinding apparatus for grinding bulk materials, the apparatus being of the type including a rotatable tub having a stationary floor, and an elongated rotor member with radially extending hammer elements, wherein said rotor member is rotatably mounted in a manner such that the hammer elements extend at least partially through the floor and into the tub, wherein the improvement comprises:

(a) elongated auger means positioned adjacent to and extending substantially along the length of said rotor member below said floor; wherein said auger means has a length at least as long as said rotor member and is laterally spaced from the axis of said rotor member;

(b) concave restricter means adjacent to and extending substantially along the length of said rotor member, wherein the position of said restricter means relative to said rotor member is adjustable;

wherein the length of said restricter means is at least equal to the length of said rotor member;

wherein bulk material is reduced in particle size by said rotor member and is conveyed away from said rotor member by said auger means; wherein said auger means includes a lower edge which does not extend below said restricter means by more than six inches.

2. The improvement in accordance with claim 1, further comprising a housing under said floor enclosing said restricter means and said auger means.

3. The improvement in accordance with claim 2, wherein a portion of said housing adjacent said auger means further comprises a wear plate.

4. The improvement in accordance with claim 3, wherein said wear plate is detachable from said housing.

5. The improvement in accordance with claim 1, wherein said auger means is parallel to said rotor member.

6. The improvement in accordance with claim 1, wherein said restricter means comprises a plurality of raised ribs facing said rotor member.

7. The improvement in accordance with claim 6, wherein said ribs are spaced-apart and extend along the length of the restricter means, wherein said ribs are parallel to each other.

8. The improvement in accordance with claim 1, further comprising adjustment means for adjusting the spacing between said restricter means and said rotor member.

9. The improvement in accordance with claim 1, wherein said restricter means comprises a stationary concave member extending downwardly from said floor and at least partially around said rotor member.

10. The improvement in accordance with claim 1, wherein said tub includes an interior wall, wherein said apparatus further comprises paddle means carried by said interior wall; wherein said paddle means is collapsible against said interior wall.

11. The improvement in accordance with claim 10, wherein said paddle means comprises a first end which is pivotably attached to said interior wall and a second end which projects into said tub from said wall; and further comprising bias means for normally biasing said second end away from said wall.

12. Tub grinding apparatus for grinding bulk materials, the apparatus being of the type including a rotatably tub having a stationary floor and an elongated rotor member with radially extending hammer elements, wherein said rotor member is rotatably mounted in a manner such that the hammer elements extend at least partially through the floor and into the tub, wherein the improvement comprises:

(a) elongated auger means positioned adjacent to and extending substantially along the length of said rotor member below said floor; wherein said auger means is parallel to said rotor members; wherein said auger means has a length at least as long as said rotor member and is laterally spaced from the axis of said rotor member;

(b) concave restricter means adjacent to and extending substantially along the length of said rotor member; wherein the length of said restricter means is at least equal to the length of said rotor member;

(c) adjustment means for adjusting the spacing between said restricter means and said rotor member;

(d) elevator means adjacent said auger means;

(e) a housing under said floor enclosing said restricter means and said auger means;

wherein bulk material is reduced in particle size by said rotor member and is conveyed away from said rotor member by said auger means; wherein said auger means includes a lower edge which does not extend below said restricter means by more than six inches; and wherein said elevator means conveys said material away from said auger means.

13. The improvement in accordance with claim 12, wherein said restricter means comprises a stationary concave member having a length at least equal to the length of said rotor member; wherein said concave member extends downwardly from said floor and at least partially around said rotor member; wherein said concave member includes spaced-apart parallel ribs facing said rotor member.

14. The improvement in accordance with claim 12, wherein said adjustment means is adapted to move said restricter means closer to or further away from said rotor member.

15. The improvement in accordance with claim 12, wherein said tub includes an interior wall, wherein said apparatus further comprises paddle means carried by said interior wall; wherein said paddle means is collapsible against said interior wall.

16. The improvement in accordance with claim 12, wherein a portion of said housing adjacent said auger means further comprises a wear plate.

17. The improvement in accordance with claim 12, further comprising a screen member partially surrounding said rotor member; wherein said screen member includes an upper edge extending above said floor member and partially over said rotor member.

* * * * *